US005261561A

United States Patent [19]

Hodges, Jr.

[11] Patent Number: 5,261,561

[45] Date of Patent: Nov. 16, 1993

[54] FISHING BUCKET ORGANIZER DEVICE

[76] Inventor: James M. Hodges, Jr., 2301 Grace Ave., New Bern, N.C. 28560

[21] Appl. No.: 31,348

[22] Filed: Mar. 15, 1993

[51] Int. Cl.[5] ..... B65D 25/10

[52] U.S. Cl. ..... 220/735; 43/54.1; 43/56; 206/315.11; 206/372

[58] Field of Search ..... 43/54.1, 56; 206/315.11, 372, 373; 220/735, 736

[56] References Cited

U.S. PATENT DOCUMENTS

| | | | |
|---|---|---|---|
| 2,870,932 | 1/1959 | Davis | 43/56 |
| 3,751,845 | 8/1973 | Van Leeuwan | 43/56 |
| 4,128,170 | 12/1978 | Elliott . | |
| 4,353,182 | 10/1982 | Junkas et al. . | |
| 4,759,148 | 7/1988 | Love | 43/54.1 |
| 4,765,472 | 8/1988 | Dent | 206/373 |
| 4,826,007 | 5/1989 | Skeie | 206/373 |
| 4,841,661 | 6/1989 | Moore | 43/54.1 |
| 4,867,332 | 9/1989 | Mains | 206/372 |
| 4,911,295 | 3/1990 | Venegoni | 206/372 |
| 4,925,026 | 5/1990 | McKay | 206/373 |
| 4,958,461 | 9/1990 | Aldrich | 47/41.01 |
| 4,993,551 | 2/1991 | Lindsay | 206/373 |
| 5,125,183 | 6/1992 | Tisdell | 43/54.1 |
| 5,174,447 | 12/1992 | Fleming | 206/373 |
| 5,186,329 | 2/1993 | Fogelberg | 220/735 |

*Primary Examiner*—Jimmy G. Foster

*Attorney, Agent, or Firm*—Norman B. Rainer

[57] ABSTRACT

A multi-compartmented storage device for seating atop a pail consists of two half portions which fit upon the rim of the pail and abut each other to form a circular structure. Slots are provided where the half portions abut for permitting passage of a carrying handle generally associated with a pail. Storage compartments are disposed upon the interior and exterior of the pail, yet access to the interior of the pail is permitted. In a preferred embodiment, a work surface panel is provided, occupying the space otherwise taken by several compartments.

4 Claims, 2 Drawing Sheets

FISHING BUCKET ORGANIZER DEVICE

BACKGROUND OF THE INVENTION

1. Field of the Invention

This invention relates to storage containers, and more particularly concerns a segmented storage tray adapted to engage the upper rim of a pail or bucket.

2. Description of the Prior Art

Numerous containers for storing small parts in an organized manner have been disclosed in the prior art. It has generally been the practice of those in the construction industry to utilize empty pails or buckets, for instance five-gallon spackling buckets, for carrying larger tools and materials such as power saws or large pipe wrenches. This practice developed by reason of the large quantity of such pails or buckets being left at construction sites after the contents thereof, for instance, spackle, were emptied therefrom. Thus, many contractors in the construction industry such as plumbers, carpenters, electricians and tilers, utilize these discarded pails or buckets for carrying tools or materials. When the pails or buckets are used for larger tools and materials, smaller tools and materials carried in the bucket may become lost or not easily retrievable from beneath larger tools.

Various bucket-engaging devices have been employed in attempts to adapt and utilize buckets or pails for the storage and transportation of small parts, tool, and other items. For example, U.S. Pat. No. 4,826,007 to Skeie discloses a tool organizer readily usable in conjunction with such a tool bucket. The device has a generally planar platform member to provide a flange-like configuration about the perimeter of the bucket, and includes a cylindrical aperture to provide access to the interior of the bucket. The device has compartmental members adapted to hold tools and materials about the upper interior and lower exterior perimeters of the bucket.

U.S. Pat. No. 4,765,472 to Dent discloses a tool-holding bucket-engaging device comprised of an elongated piece of flexible material formed with pockets for receiving and holding tools. The two ends of the piece of material join together to form a closed loop when the device is wrapped around the exterior sidewall of the bucket. Snaphooks disposed at the top edge of the loop clip onto the bucket handle, thereby suspending the device.

U.S. Pat. No. 4,911,295 to Venegoni discloses a circular, multi-compartmented bucket organizing tray adapted to fit in multiple stacking formation within a bucket. The trays each have multiple divider walls of fixed and removable configuration and a central molded carry handle. Parts of small nature may be stored within the trays, however, no provision is made for the carrying of large tools or other objects.

Another commonplace use of emptied buckets is as a multi-purpose carrier for fishermen. Such buckets are used to carry fish, bait, ice, tackle, food, and beverages, etc. Buckets are typically used to carry such items from a vehicle to a boat, the shoreline, or fishing pier because it is desirable for the fisherman to make as few trips as possible with limited carrying capacity. The disadvantage of using a bucket to carry tackle along with the aforesaid items is that tackle is difficult to reach at the bottom of the bucket and becomes soiled with fish blood, slime, scales, and the like.

Although the aforesaid bucket organizing devices would have some utility to the fisherman, the devices suffer from certain limitations. The Skeie device is not amenable to fish, bait and ice storage due to its interiorly disposed tool-holding elements. Furthermore, the flange top surface is adapted to carry elongated handled tools, not tackle. The Venegoni device is not amenable to bulk storage of ice, fish, bait etc. as the trays would become soiled. The Dent device is clearly not amenable to the carrying of tackle i.e. swivels, hooks, line and terminals. Moreover, none of the aforesaid devices disclose means for cutting and preparing bait. Although bait cutting boards are commercially available which engage buckets, they are not integral to tackle organizing means.

It is accordingly an object of the present invention to provide a compartmented storage container adapted to removably engage a bucket or pail.

It is another object of the present invention to provide a storage container of the aforesaid nature permitting uninhibited access to the interior region of the bucket.

It is a further object of this invention to provide a storage container of the aforesaid nature having an integral bait cutting surface.

It is yet another object of this invention to provide a storage container of the aforesaid nature which is durable, adapted to be easily engaged and removed from a variety of standard buckets, and amenable to low cost manufacture.

These and other beneficial objects and advantages will be apparent from the following description.

SUMMARY OF THE INVENTION

The above and other beneficial objects and advantages are accomplished in accordance with the present invention by a compartmented organizer device adapted to removably associate with a bucket having an interior region bounded by a circular bottom panel and cylindrical sidewall, said sidewall having an upper extremity terminating in a circular rim, said bucket further having an arcuate carry handle having opposed extremities pivotally associated with said bucket near said rim, said organizer device comprised of first and second halves elongated in a semi-circular contour between laterally opposed extremities, each half of monolithic construction and adapted to abut at said extremities to form a substantially circular structure, said first half comprised of:

a) an interior portion comprised of a flat floor panel having top and bottom surfaces and inner and outer perimeters contoured as concentric circular arcs, an interior cylindric wall upwardly emergent from said inner perimeter in orthogonal relationship to said top surface, and an exterior cylindric wall upwardly emergent from said outer perimeter in orthogonal relationship to said top surface and concentrically disposed to said interior wall, said interior portion having a uniform substantially squared U-shape cross-sectional contour taken in a vertical plane radially disposed to said cylindric walls, b) an exterior portion bounded by a flat floor panel having top and bottom surfaces and inner and outer perimeters contoured as concentric circular arcs, an interior cylindric wall upwardly emergent from said inner perimeter in orthogonal relationship to said top surface, and an exterior cylindric wall upwardly emergent from said outer perimeter in orthogonal relationship to said top surface and concentrically disposed with relation to said interior wall, said exterior portion having a uniform substantially squared U-shape cross-sectional contour taken in a vertical plane radially disposed to said cylindric walls, c) a flat bridging panel in parallel disposition to said top surfaces and joining the exterior cylindric wall of said interior portion and the interior cylindric wall of said exterior portion, and thereby forming a downwardly opening annular groove adapted to accommodate the rim and sidewall of said bucket, d) a plurality of radially disposed vertical partitions upwardly emergent from the top surfaces of said interior and exterior portions and extending laterally to joinder with the corresponding cylindric walls, said partitions defining compartments further bounded by said top surfaces and opposed cylindric walls, and e) slots disposed within said bridging panel and opening upon each lateral extremity to permit passage of said carry handle.

The second half may be identical to the first half, disposed in facing relationship to permit said extremities to interengage to form a circular structure.

The second half may alternatively be a modification of said first half wherein a work surface panel co-planar with said bridging panel spans at least two contiguous partitions of said exterior portion and the corresponding contiguous partitions of said interior portion.

The two halves are preferably formed of plastic material by way of a molding operation. The work surface of the alternative second half component serves as a surface as for cutting bait. The two halves are adapted to be brought into abutment at their lateral extremities at the sites on the bucket where the carry handle is attached. In such manner of engagement, the apertures in the bridging panels meet in embracing relationship about the carry handle.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
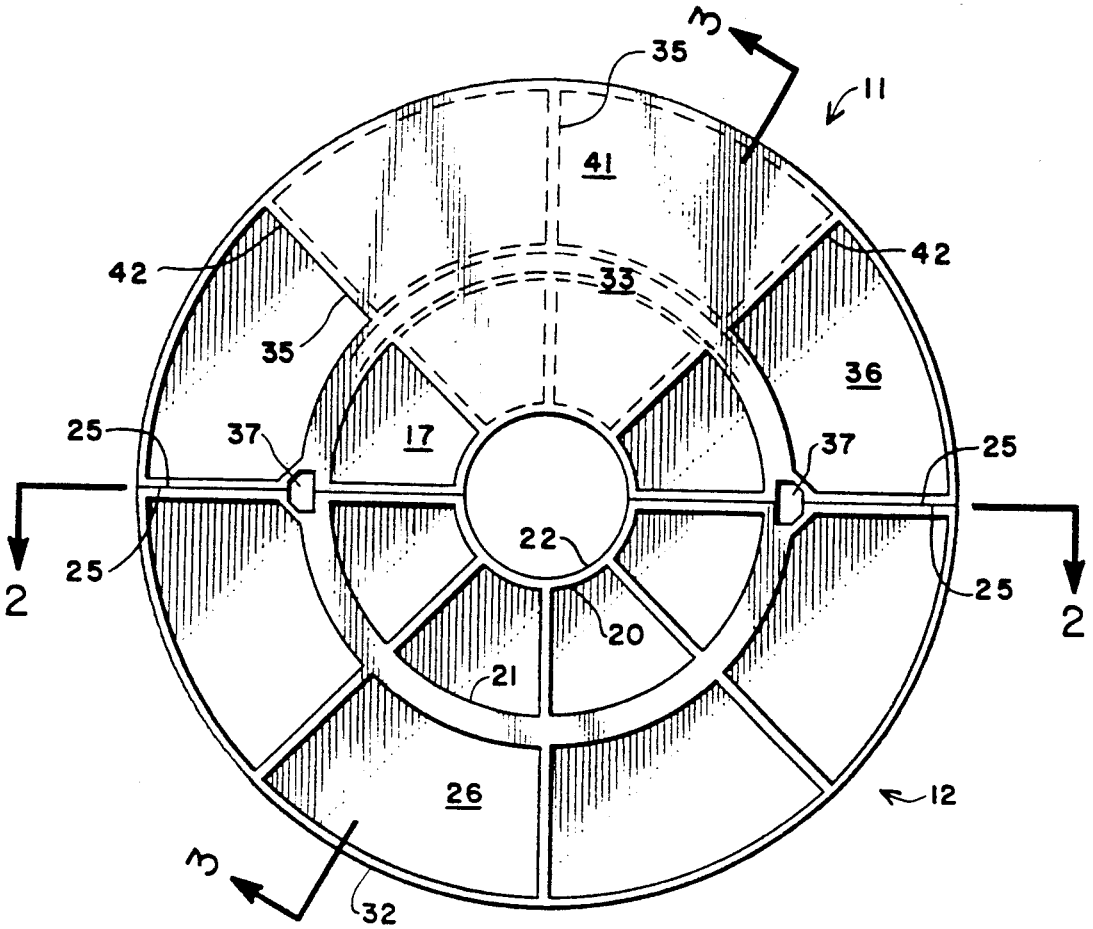
FIG. 1 is a top plan view of an embodiment of the bucket organizer device of the present invention.
Figure 2:
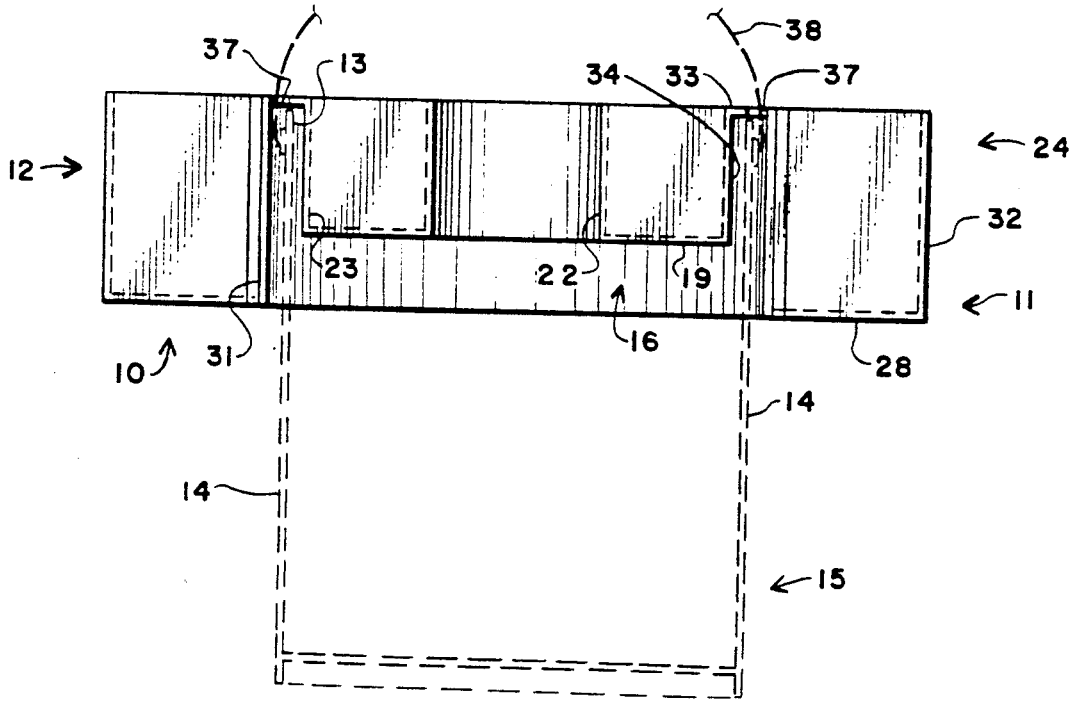
FIG. 2 is a vertical sectional view of the embodiment of FIG. 1 taken upon the 2—2 line of FIG. 1.
Figure 3:
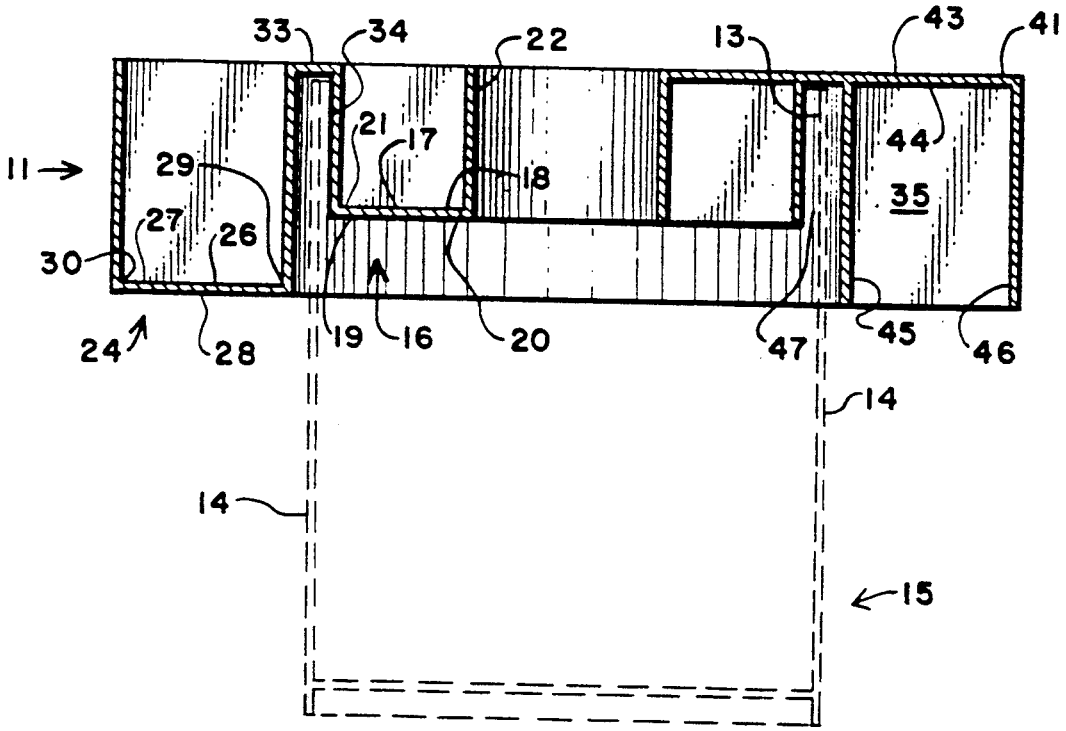
FIG. 3 is a vertical sectional view taken in the direction of the arrows upon line 3—3 of FIG. 1.

Referring to FIGS. 1-3, an embodiment of the bucket organizer device 10 of the present invention of substantially circular structure is shown comprised of first half 11 and second half 12 disposed upon the upper rim 13 and sidewall 14 of bucket 15 having handle 38. Each half is elongated in a semi-circular contour between laterally opposed extremities 25 adapted to abut each other to form said circular structure.

Said first half is comprised of interior portion 16 comprised of flat floor panel 17 having top and bottom surfaces 18 and 19, respectively, and inner and outer perimeters 20 and 21, respectively, contoured as concentric circular arcs. Interior cylindric wall 22 is upwardly emergent from said inner perimeter in orthogonal relationship to top surface 18. Exterior cylindric wall 23 is upwardly emergent from outer perimeter 21 in orthogonal relationship to top surface 18, and concentrically disposed to interior wall 22.

The interior portion has a uniform, substantially squared U-shape cross-sectional contour viewed in a vertical plane radially disposed to said cylindric walls. It is to be noted that the diameter of interior wall 22 is large enough to permit a person's hand to enter the interior of bucket 15. Such diameter will be in the range of 4 to 7 inches.

Exterior portion 24 of said first half is bounded by flat floor panel 26 having top and bottom surfaces, 27 and 28, respectively, and inner and outer perimeters 29 and 30, respectively, contoured as concentric circular arcs. Interior cylindric wall 31 is upwardly emergent from inner perimeter 29 in orthogonal relationship to top surface 27. An exterior cylindric wall 32 is upwardly emergent from outer perimeter 30 in orthogonal relationship to top surface 27 and concentrically disposed with relation to interior wall 31.

Like interior portion 16, exterior portion 24 has a uniform, substantially squared U-shaped cross-sectional contour as viewed in a vertical plane radially disposed to said cylindric walls.

Flat bridging panel 33 is disposed in parallel relationship to said floor panels, and joins the exterior cylindric wall of said interior portion to the interior cylindric wall of said exterior portion. Such configuration creates a downwardly opening annular groove 34 adapted to accommodate the rim and sidewall of the bucket.

A plurality of radially disposed vertical partitions 35 are upwardly emergent from the top surfaces of the floor panels of said interior and exterior portions, and extend laterally to joinder with the corresponding cylindric walls. Said partitions thereby define compartments 36 further bounded by said top surfaces and cylindric walls.

Slots 37 disposed within cylindric wall 31 open onto bridging panel 33 and lateral extremity 25. When such slots of the first and second halves are brought together, they permit passage of carry handle 38.

The second half 12 may be identical the first half 11. Both halves abut at their extremities 25 to form the circular organizer device of this invention. In such manner of installation to bucket 15, the device is securely emplaced, yet permits passage of carry handle 38. The interior portions of both halves are shown to reside within the bucket, whereas the exterior portions of the halves reside outside the bucket.

In the illustrated embodiment, the second half is of different configuration that the first half. In particular, second half 11, has a flat horizontally disposed work surface panel 41 having substantially the shape of a sector of a circle bound by lateral extremities 42 coinciding with the upper extremities of partitions 35 and having top and bottom surfaces 43 and 44, respectively. Interior and exterior cylindric walls 45 and 46, respectively, are downwardly emergent from bottom surface 44, and are spaced apart in concentric relationship. Said walls, in conjunction with work surface panel 41 form a downwardly opening groove 47 having a size and shape to accommodate the rim and sidewall of bucket 15. In this particular embodiment of the invention, the first half provides storage compartments, while the second half provides a work surface and possibly additional storage compartments. In the illustrated embodiment of second half 11, the work surface panel occupies space that would otherwise be occupied by two compartments of said interior portion and two compartments of said exterior portion.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A compartmented organizer device adapted to removably associate with a bucket having an interior region bounded by a circular bottom panel and cylindrical sidewall, said sidewall having an upper extremity terminating in a circular rim, said bucket further having an arcuate carry handle having opposed extremities pivotally associated with said bucket near said rim, said organizer device comprised of identical first and second halves elongated in a semi-circular contour between laterally opposed extremities, said halves adapted to abut at said extremities to form a substantially circular structure, each half comprised of:

a) an interior portion comprised of a flat floor panel having top and bottom surfaces and inner and outer perimeters contoured as concentric circular arcs, an interior cylindric wall upwardly emergent from said inner perimeter in orthogonal relationship to said top surface, and an exterior cylindric wall upwardly emergent from said outer perimeter in orthogonal relationship to said top surface and concentrically disposed to said interior wall, said interior portion having a uniform substantially squared U-shape cross-sectional contour taken in a vertical plane radially disposed to said cylindric walls, b) an exterior portion bounded by a flat floor panel having top and bottom surfaces and inner and outer perimeters contoured as concentric circular arcs, an interior cylindric wall upwardly emergent from said inner perimeter in orthogonal relationship to said top surface, and an exterior cylindric wall upwardly emergent from said outer perimeter in orthogonal relationship to said top surface and concentrically disposed with relation to said interior wall, said exterior portion having a uniform substantially squared U-shape cross-sectional contour taken in a vertical plane radially disposed to said cylindric walls, c) a flat bridging panel in parallel disposition to said top surfaces and joining the exterior cylindric wall of said interior portion and the interior cylindric wall of said exterior portion, and thereby forming a downwardly opening annular groove adapted to accommodate the rim and sidewall of said bucket, d) a plurality of radially disposed vertical partitions upwardly emergent from the top surfaces of said interior and exterior portions and extending laterally to joinder with the corresponding cylindric walls, said partitions defining compartments further bounded by said top surfaces and opposed cylindric walls, and e) paired, diametrically opposed slots disposed within each lateral extremity to permit passage of said carry handle.

2. The device of claim 1 wherein each half is of monolithic construction.

3. The device of claim 1 wherein said second half is different from said first half by virtue of having a work surface panel in coplanar relationship with said bridging panel and spanning at least two adjacent partitions of said exterior portion and the corresponding adjacent partitions of said interior portion.

4. The device of claim 1 wherein the diameter of the interior cylindric wall of said interior portion is between about 4 and 7 inches.

* * * * *